US005608999A

United States Patent [19]

McNamara

[11] Patent Number: 5,608,999

[45] Date of Patent: Mar. 11, 1997

[54] PREFABRICATED BUILDING PANEL

[76] Inventor: Bernard McNamara, 122, rue Guibault, Longueuil (Québec), Canada, J4H 2T2

[21] Appl. No.: 507,881

[22] Filed: Jul. 27, 1995

[51] Int. Cl.[6] ..... E04B 2/28; E04B 2/72

[52] U.S. Cl. ..... 52/275; 52/426; 52/429; 52/220.1; 52/783.1; 52/563; 52/588.1; 52/731.3

[58] Field of Search ..... 52/275, 279, 282.1, 52/588.1, 589.1, 591.1, 592.1, 783.1, 731.2, 731.3, 732.1, 732.2, 563, 571, 426, 427, 429, 442, 220.1; 249/33, 36, 38, 40, 219.1, 216, 194

[56] References Cited

U.S. PATENT DOCUMENTS

| | | | |
|---|---|---|---|
| 2,164,681 | 7/1939 | Fould | 52/731.3 X |
| 2,406,581 | 8/1946 | Kratzmaier | 52/275 X |
| 3,184,013 | 5/1965 | Pavlecka | 52/275 |
| 3,279,137 | 10/1966 | Pavlecka | 52/275 |
| 3,440,785 | 4/1969 | Denny et al. . | |
| 3,618,281 | 11/1971 | Hill et al. | 52/275 X |
| 4,180,956 | 1/1980 | Gross | 52/563 X |
| 4,433,522 | 2/1984 | Yerushalmi | 52/426 |
| 4,821,476 | 4/1989 | Thoburn et al. | 52/282.1 X |
| 5,311,718 | 5/1994 | Trousilek . | |
| 5,491,947 | 2/1996 | Kim | 52/426 |

*Primary Examiner*—Robert Canfield
*Attorney, Agent, or Firm*—F. Martineau

[57] ABSTRACT

An assembly of extruded thermoplastic structural components for use in the construction of a building, each structural component including an elongated rigid sheet member provided with at least two integral lengthwise edgewise rails. The structural components include first flat wall structural components and second elbowed corner structural components, wherein a few of the structural components releasably slidingly interlock with one another about their rails to form a hollow elongated panel. The inside cell of the hollow panel receives concrete to be poured. The hollow panel releasably interlocks with adjacent hollow panels successively to form a continuous wall structure. The structural components in their disassembled state released from one another are compactly stackable in the smallest volume of storage, whereby shipping costs from the home country manufacture to the local building site are very low.

4 Claims, 10 Drawing Sheets

PREFABRICATED BUILDING PANEL

FIELD OF THE INVENTION

This invention relates to interlocking factory-made structural components, particularly extruded plastic components, for assembly by unskilled labour into a building.

BACKGROUND OF THE INVENTION

Currently, there are two main methods used for the construction of concrete buildings:

1. assembling individual casings on each building site, and then pouring the liquid concrete in these casings before it is allowed to set. The delays for constructions in this case are quite lengthy.

2. Providing precast factory-made components, which substantially decrease the time required for in situ assembly of the house. Unfortunately, a significant disadvantage is that heavy machinery is required for this method. Moreover, transportation costs of the factory-made components, and the associated distance between the building site and the extrusion manufacturing facility, become major cost elements.

Major trends in the construction business include a progressive shift from conventional structural components, namely wood, steel and aluminum, toward extruded plastic material-based panel products having enhanced value added factory-made features, increased durability, decreased maintenance requirements and major domestic energy consumption savings features. PolyVinyl Chloride (PVC) is particularly appreciated, since it is cost effective: having 56% of chloride in weight (supplied from halite) and only 44% of hydrocarbons, PVC will be less cost-sensitive than other plastic materials to the cyclical variations in the market prices of petroleum products and of ethylene in particular.

Such plastic based wall panels are desirable, because of their resistance to weather, to impacting and to abrasive forces, because they have a good loading resistance relative to its weight, a very high resistance to the destructive action of chemical agents and a good resistance to combustion, rust, salt, insect damages, and rot. These plastic panels apply not only to domestic buildings or houses, but also to industrial, commercial and institutional buildings, and not excluding gazebos, partitions, sound barriers along highways, farm buildings and barns, and sheds.

Canadian patent application No 2,070,079 published Nov. 30, 1993 in the name of Vittorio DE ZEN, discloses a building constructed of extruded, thermoplastic, structural components. The building is based on a system of factory-made components developed in such a way as to include all the components required for the assembly on the building site of a house with unskilled labour. The extruded modular components are edgewisely interlocked to one another to form continuous, flat wall panels for forming the upright walls and roof parts of the building. More particularly, the side walls and roof panels are said to be configured to be connected into the housing structure by interlocking mating engagement with adjoining members so that they can be assembled without the use of tools. Each wall panel is hollow, is made from PVC plastic material, and consists of spaced exterior and interior walls connected by transverse webs forming internal cells.

Such a wall panel system is lightweight and very easy to assemble by unskilled labour. It appears basically as a casing into which concrete is poured to form smooth, aesthetically appealing interior and exterior plastic wall faces which require minimal maintenance compared to houses built according to different standards.

On the building sites, after assembly of the hollow wall panels, the internal cells can then be filled with uncured (liquid) concrete and\or a flowable thermal insulation material. Hence, a self-supporting structure can be erected and anchored to a base and converted into a permanent and sturdy structure.

The De Zen structural components as disclosed include extruded hollow panels, extruded hollow pane box connectors, extruded hollow beams and adapters, and extruded panel connectors. All these structural components are factory made, so that they can be assembled on the building sites by unskilled workers in a short period of time. Interior and exterior doors, windows, electrical and plumbing lines, cupboards, and other building elements can be accommodated by this system.

An important disadvantage of such hollow extruded panels pertains to their transportation to the building site: since they are hollow, they take a relatively important volume in the truck van storage area, i.e. a lot of empty space trapped by the hollow panels is wasted during shipping thereof.

In particular, within the new commercial environment created by the North American Free Trade Agreement (NAFTA), trade barriers such as tariffs between Canada, the United States and Mexico have disappeared or are in the process of disappearing. Accordingly, the importance of transportation costs of building components have increased as a percentage of the total costs of building constructions.

U.S. Pat. No. 3,992,839 issued Nov. 23, 1976 to the Ethyl Corporation, also discloses hollow extruded wall members, which are interconnected by transversely extending integral male and female connectors. More particularly, each wall member includes two main parallel wall panels spaced from one another by the transverse connectors. The male connector forms an arrow shape stud, while the female connector forms a complementary socket. The male and female connector elements interlock horizontally with one another in snap-on or clipping, generally unadjustable fashion, along interconnecting axes being orthogonal to that of the parallel (interior and exterior) side wall panels. Additional open tubular corner connector beams are provided, to interlock two adjacent wall members at a 90° degree relative to one another.

One disadvantage of such an extruded wall system as in the Ethyl patent, is that substantial volume is once again wasted during shipping of the corner connector beams, since again, these corner connectors circumscribe a hollow. Moreover, because the axes of interconnection of the wall panels are orthogonal to the planes of the wall panels, a separate corner connector element is required to interlock the two adjacent corner wall panels, thus increasing the total number of wall components required for assembling the building. Thirdly, such transverse connector studs are more likely to be accidentally damaged during handling thereof in the shipping process, because they protrude from the main panel walls, and because they are of the snap-on type. Also, relative adjustment of the panels is difficult, because once the male and female connectors are clipped together, they are not designed to be thereafter relatively movable.

OBJECTS OF THE INVENTION

The gist of the invention is to provide a system of lightweight plastic building wall and roof modular components for building construction, which may be stacked in a very efficient fashion in their disassembled state so as to take the smallest loading volume during shipping.

An important object of the invention is that said modular components be of easy assembly by unskilled labour.

A general object of the invention is to provide a building system combining home country state of the art technology with local labour and locally available building materials (usually concrete), wherein the total project cost for a building unit be very low.

Another object of the invention is that the building system consist of several plastic components which will be used as casings for receiving and supporting therein the concrete.

An object of the invention is to improve upon published Canadian patent application No 2,070,079, supra.

SUMMARY OF THE INVENTION

Accordingly with the objects of the invention, there is disclosed an assembly of extruded thermoplastic structural components for use in the construction of a building, each structural component including an elongated rigid sheet member provided with at least two integral lengthwise edgewise rail members, said structural components including first flat wall structural components and second elbowed corner structural components, wherein a few of said structural components releasably slidingly interlock with one another about their said rail members to form a hollow elongated panel; wherein each said hollow panel defines a body, including a flat exterior face and a flat interior face, and circumscribing a generally closed inner enclosure cell, said inner cell for receiving concrete to be poured and said hollow panel body adapted to withstand the load of a column of concrete poured therein; said sliding interlock engagement between said few structural components forming said hollow panel defining continuous lengthwise adjustment means for one said structural component relative to the other of said few structural components, said hollow panel releasably interlocking with adjacent hollow panels successively to form a continuous wall structure; and wherein said structural components in their disassembled state released from one another are compactly stackable in the smallest volume of storage whereby shipping costs from the home country manufacture to the local building site are very low.

Preferably, the thermoplastic material used in said structural components is polyvinyl chloride, admixed with at least one of the following reinforcing and stabilizing material: mineral fibres and filling materials.

Each said first structural component could further include additional lengthwise rail members, located intermediately of the first mentioned rail members; and further including at least one third structural component, being of cross-sectionally U-shape and having a pair of lengthwise edgewise flanges, said flange slidingly adjustably releasably engaging said additional intermediate rail members of a given said first structural component wherein said first and third structural components become interlocked; and wherein a generally closed channel is defined by said third structural component within said inner cell of a said hollow panel member, for free lengthwise passage of electrical lines.

Such a prefabricated building construction system uses thermo-setting plastic extrusions. This system has been conceived for the construction of low-cost buildings and enable production of all the structural components on a large scale.

These plastic based extrusions will be factory-made, being precut and prelabelled to be assembled on the building sites by unskilled labour in countries where demand for this type of building is high. The wall extrusions are thereafter filled with concrete, while the extrusions forming the roof may be filled by regular concrete or by concrete mixed with polystyrene pellets which will permit the increase of the thermal ratio of the roof while decreasing also the roofing weight. The extrusions can be stacked in a compact fashion, so as to reduce the shipping costs. These buildings will therefore be quite economical and may be sold in all developing countries. This building system will use state of the art techniques for the structural plastic components in the home country factory, while an unskilled labour force and local concrete will be used on the building sites.

This building system is in fact a system of wasted casing, which may also be used for manufacture of a wide variety of structures such as fences, docks or privadas. The buildings manufactured with this system are for all practical purposes built from monolithic ferro-concrete. They will therefore be resistant to earthquakes, termites, corrosion, rot, hurricanes, and generally speaking to damaging weathering action.

The wall and roofing extrusions have been developed so as to resist to concrete expansion during setting thereof. The extrusions are assembled together so as to constitute a hollow wall by sliding same vertically from the top down, adjustably one into the other. Bores are made in the extrusions forming the web of the wall, so as to allow concrete to seep from one cell to another so as to make a monolithic wall. Moreover, reinforcing steel rods may be mounted to the base and to the top of the wall, to improve resistance of the concrete.

Several auxiliary extrusions are envisioned, so as to constitute the outer corners of the L-walls, the T intersections of the walls, the top and bottom sills, the roof soffits, and the extrusions which are used as adaptors for the doors and windows.

The system is a complete system including false frames to receive windows and doors, a roof frame system moulded in place thanks to a fibreglass casing (or with wooden beams), together with all the adaptors required for constituting the complete envelope of a building.

The extrusions have been developed so as to support therein the load of concrete. The main extrusions may be made from recycled PVC. A thin layer of co-extrusion will then be made in coextrusion over the exposed surface of these extrusions. The extrusions may be deep-dyed or may be painted thereafter.

The whole system is conceived and controlled by computer. This enables to make the components on a large scale, but also to personalize each of the buildings according to the particular needs of the clients. CAO-FAO computer conception and manufacture enables excellent inventory management and follow-up of working and shipping schedules.

The building components are characterized in that they are made from a plastic material, preferably extruded PVC; that they are finished on both sides, so that no outer or inner coating is to be installed thereafter; that the PVC extrusions interlock into one another so as to make a hollow wall ready to receive concrete; that some of these components carry therein channels to receive electrical lines which will be concealed in the walls and roofs; that a low number of different components will be required to make a building; that these building components may have varying textures and colours; and that the components are of modular dimensions, the dimensions of the doors and windows having therefore to conform to these component dimensions.

DETAILED DESCRIPTION OF THE EMBODIMENTS OF THE INVENTION

Figure 1:
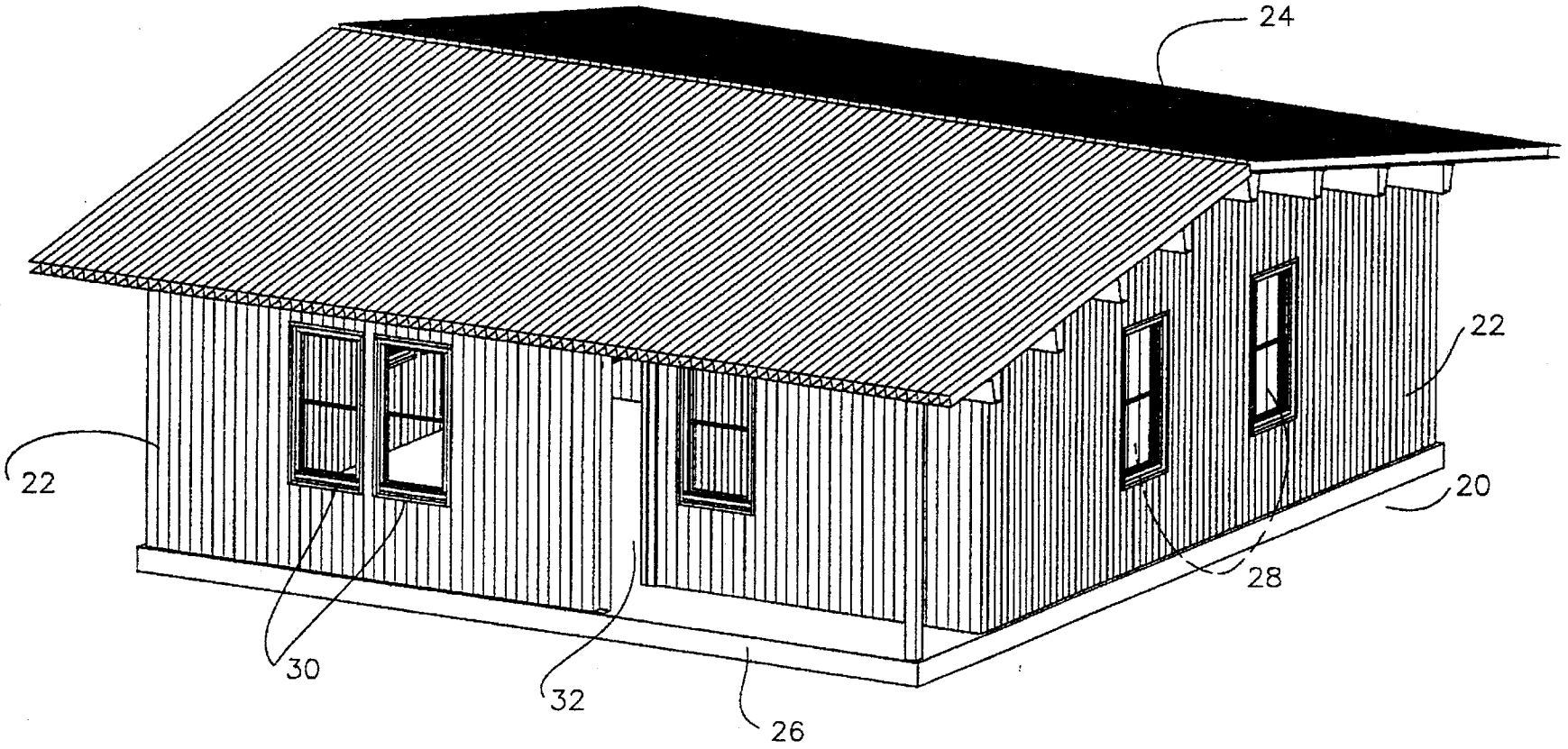
FIG. 1 is a perspective view of a house constructed with the modular plastic components of the present invention, into which concrete has been poured.
Figure 2:
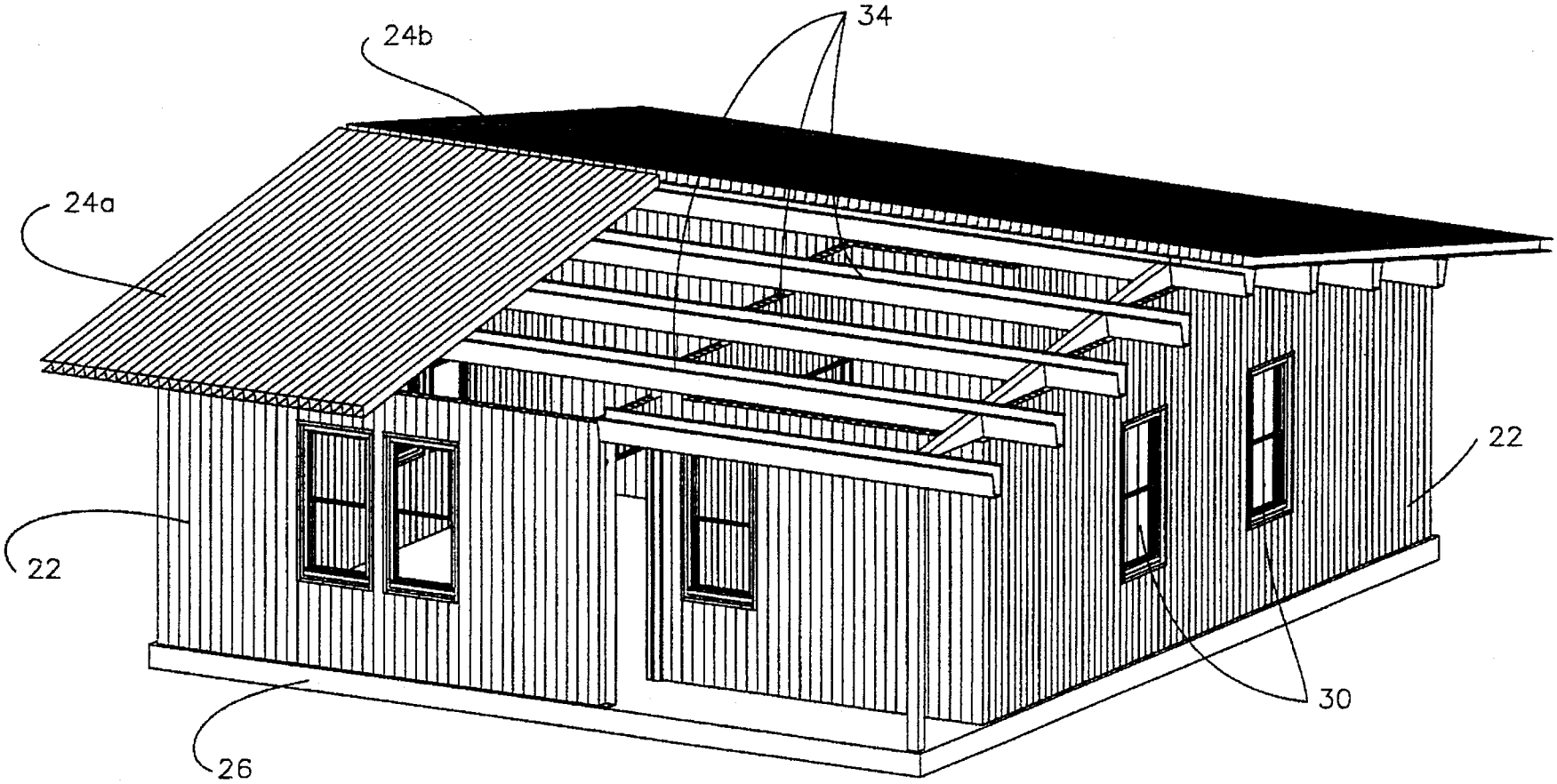
FIG. 2 is a view similar to FIG. 1 but with a fraction of the roof panels being removed to show the roof frame rafters, and suggesting that the roofing is made from a precast fibreglass casing into which is poured reinforced concrete.
Figure 3:
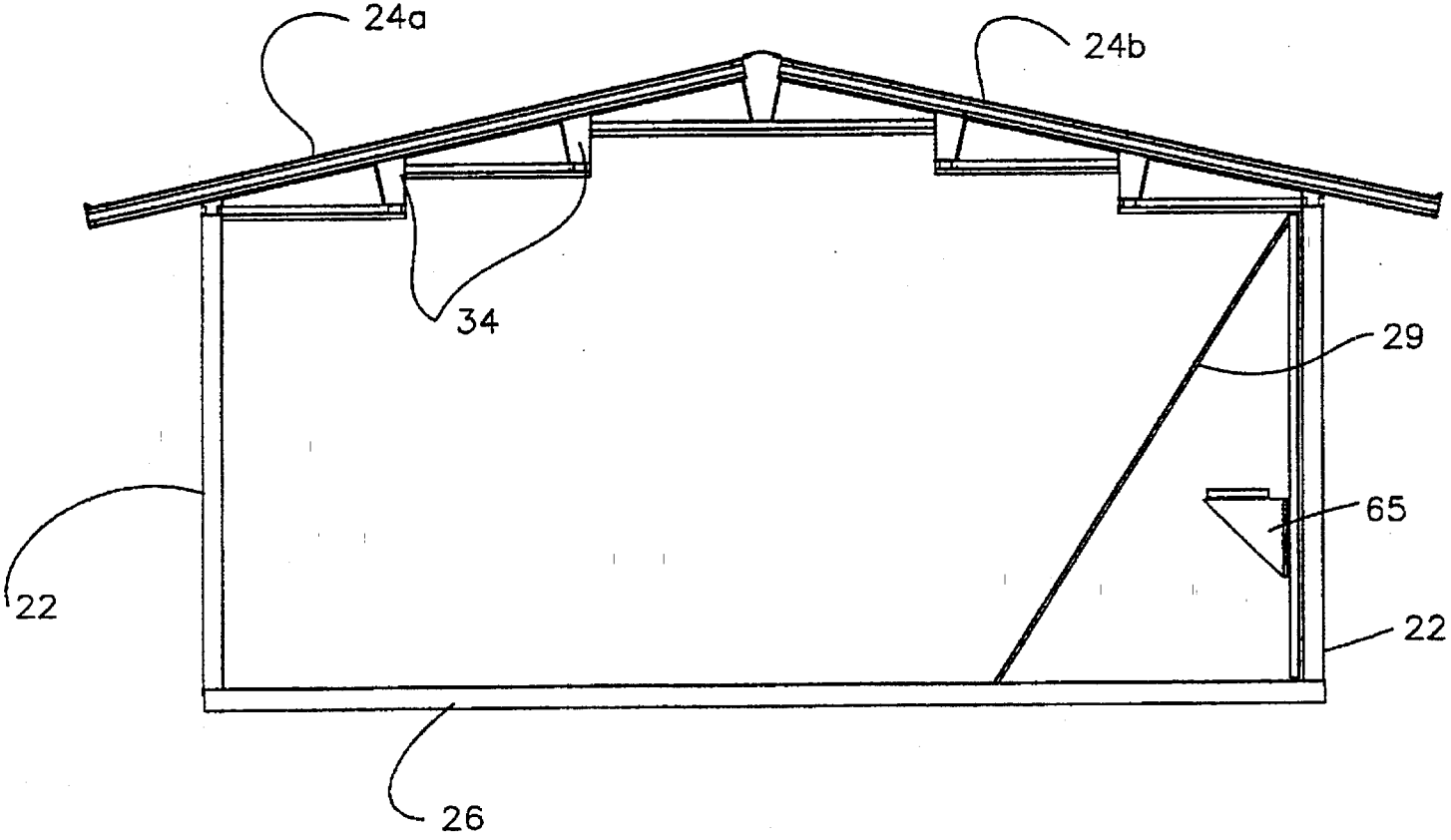
FIG. 3 is a vertical sectional view of the house of FIG. 1, showing in cross-section the wall panels and roof panels according to the invention, together with top and bottom sills.
Figure 14:
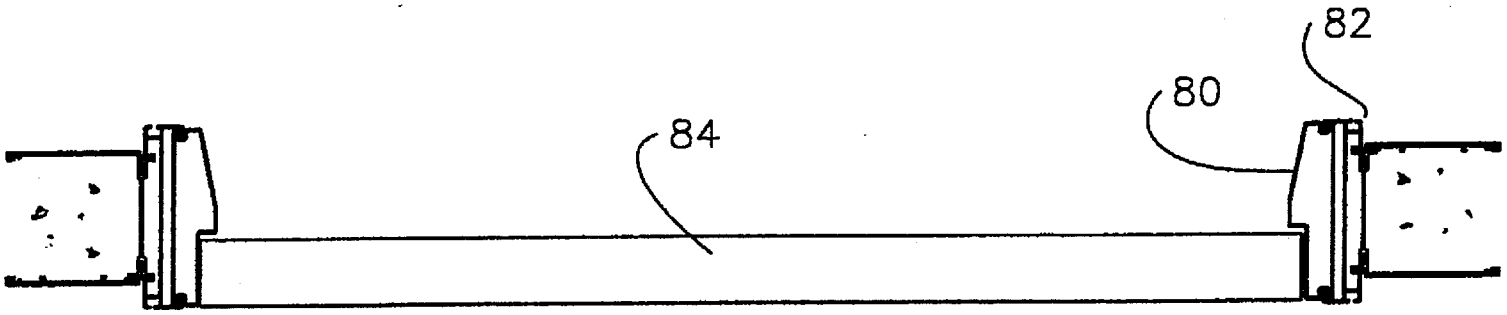
FIGS. 14 and 15 are vertical sectional views of an intermediate section of upright wall panel from the building of FIGS. 1–2, suggesting how a door and a window can respectively be mounted into corresponding door and window frames mounted into wall apertures therein.

House 20 illustrated in FIGS. 1–3 is constructed according to the teachings of the invention, and includes upright side walls 22, a sloping roof 24, and a ground basement concrete flooring 26 cast on the building site. To the peripheral edge of the concrete flooring 26, there is mounted a lower sill, which can receive the wall extrusions (as detailed later). To accommodate windows 74 in the side wall 22, window apertures 28 should be made in the side wall 22, into each of which is mounted a window frame assembly 30. The window apertures 28 may be made by selectively sectioning at the home base factory the extrusion panels at different lengths. A large door opening 32 should also be made through side wall 22, for hingedly mounting therein an access door 84 (FIG. 14). Elongated rafters 34 support the two diverging roof sections **24*a*, 24*b*, over the top ends of the house side walls 22, while the concrete ground basement flooring 26 supports the bottom ends of the upright side walls 22**.

Figure 4:
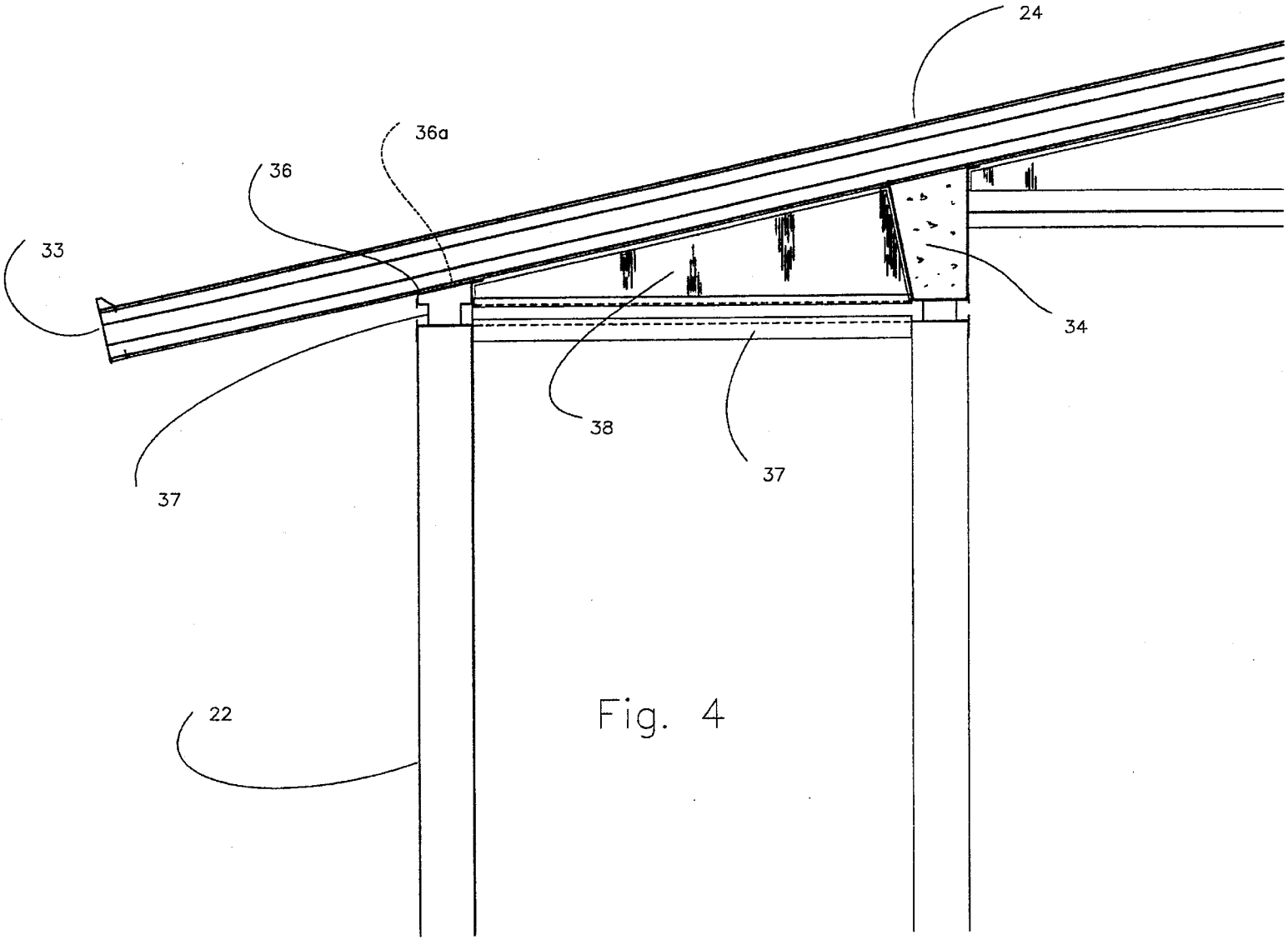
FIG. 4 is a view at an enlarged scale of the area at the upper left side of FIG. 3.
Figure 5:
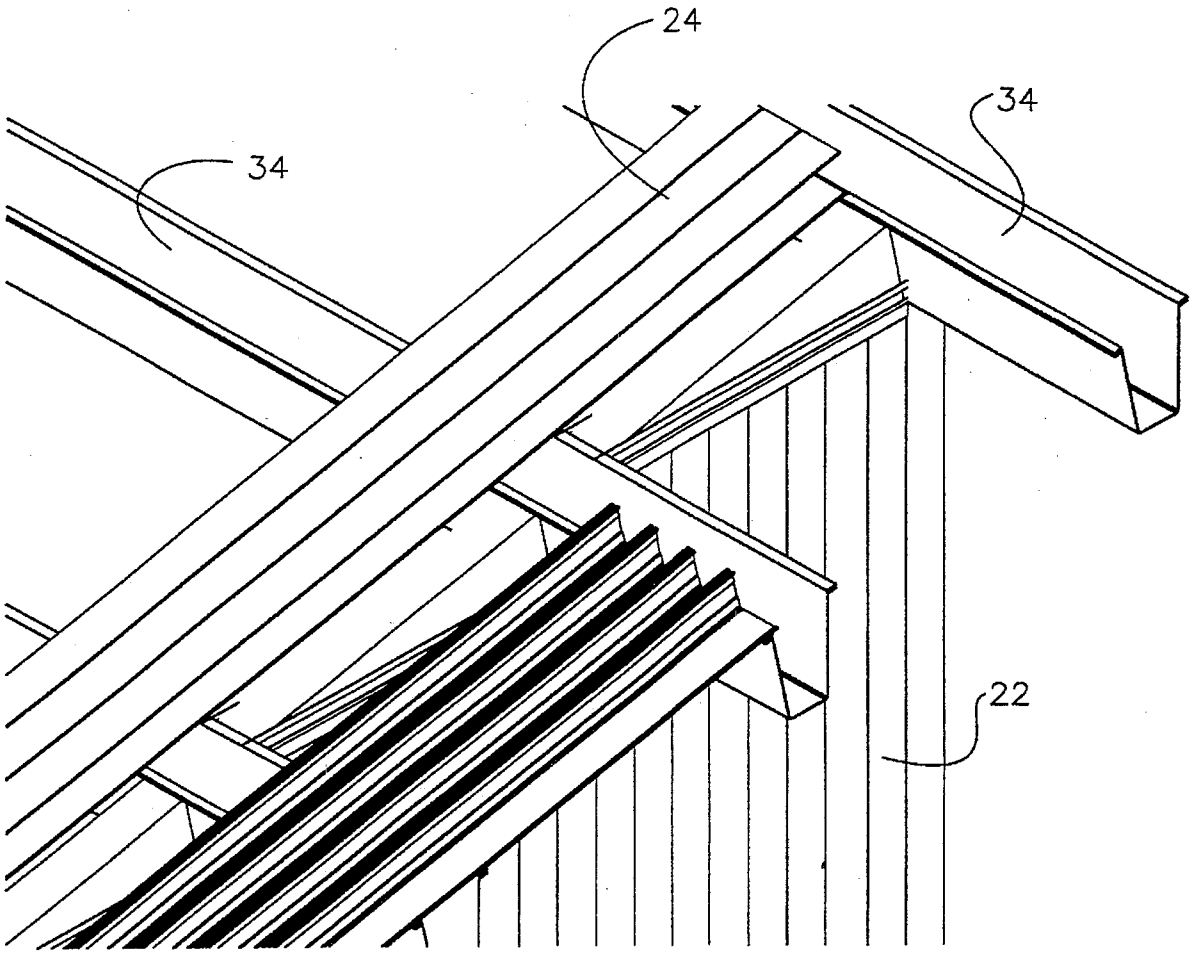
FIG. 5 is an isometric view of the building elements of FIG. 4, showing the connection between the various wall and roof components.
Figures 9, 10, 11, 12, 13:
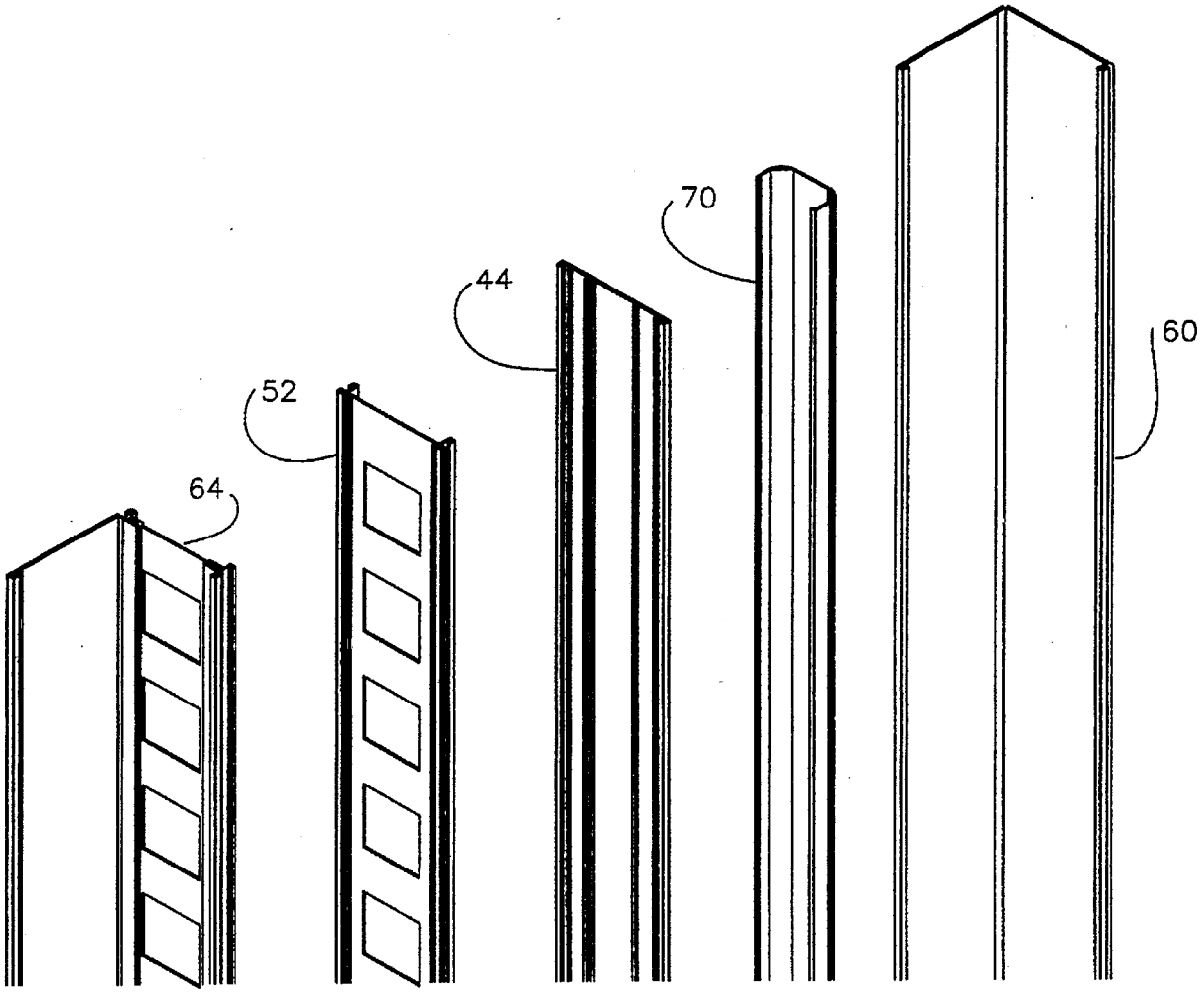
FIGS. 9 to 13 are isometric views of five different modular panel components according to the invention, with the V-shape component shown in FIG. 9 forming most of the elements of the system.

FIGS. 4–5 suggest how the roof 24 is supported by the side walls 22 of the house 20. On all side walls 22, there is a top sill 38. However, the front walls are covered by a top sill 38 in which is mounted a shim 36, to accomodate the fact that the roof does not make a right angle with the building side wall. The roofing elements 52 and 64 are laid over the shim. The beams from FIG. 9 can be seen, as well as the filling components (FIG. 11). The conventional flashing 33 is located at the bottom edge of the roof slope.

In FIG. 4, to the top of all side walls 22 is mounted a top sill 37, which interlocks to the top end of the side walls 22 and may be secured thereto by screws into the screw groove made on the extrusion 64 of FIG. 9. This sill 37 discloses on each side a ridge enabling the setting of electrical lines which may be connected to the hollow channels 70 (FIG. 6, detailed below), and installed horizontally. Moreover, this sill 37 is used as an anchor for a stay 29, shown in FIG. 3, during concrete pouring to reinforce the upright side wall 22. This stay consists of an upright steel extrusion, abutting against the interior side of the building upright wall 22 and anchored at its top end to the wall 22 in the upper sill 37.

An inclined adjustment stem 29 (FIG. 3) is anchored to the flooring at a distance of approximately 1 to 2 meters from the base of the wall 22, and a square is provided to support the wooden beams (and thus make a scaffolding so that the workers may pour the concrete into the walls). These stays must be installed at approximately two meters intervals, and are recovered after completion of the building construction for other projects.

The roofing 24 is inclined, with the lateral walls 22 having different lengths so as to support this sloped roof. Considering that the system does not provide for any sectioning of pre-cut extrusions on the building sites and that it is almost impossible to manufacture pre-cut extrusions having different lengths relative to one another with respect to the roof slope, the lateral walls 22 of the building are therefore made as a ladder, i.e. in steps. In other words, taking into account that the beams are mounted at one meter intervals, the top of the wall supporting these beams will be straight and will increase in height by 20 centimeters increments at each meter. No sectioning will therefore be required on the building site, and the extrusions of the lateral walls 22 will be of a different length but these types of lengths will be limited. The top of these lateral walls 22 being made in steps, they will receive the upper sill 37 onto which a triangular panel 38 will be mounted to fill the gap between the building side wall 22 and the sloped roof 24. This triangular panel 38 may be made from full or empty wood, of a frame with an integral mosquito net to afford good air circulation, of a frame with permanent glass, or with ventilation louvres, according to the tastes of the customer.

In FIG. 5, we can see the concrete beams or rafters, 34, supporting the roof 24, which are made integral to the PVC casing 64 (FIG. 9) as well as the filling components 44 (FIG. 11) between the rafters. The rafters or beams 34 will be made from concrete cast on the building sites into fibreglass casings, which will be mounted beneath the lateral walls 22 and which will bear under the interior walls. As already explained, during the concrete pouring, temporary stays will be added at about two meters intervals, to support the concrete during pouring. Reinforcing steel rods will be mounted interiorly of this casing, so as to make reinforced concrete beams.

Although this system works very well, it is possible to replace these ferro-concrete beams, depending on the tastes of the customers, by wooden beams of the painted or varnished type. The ferro-concrete beams will be connected to the wall by reinforced steel rods included into the ferro-concrete of the walls and of the rafters 34. In the same fashion, the roof 24 will be connected to the rafters 34 by reinforcing steel rods cast into the rafter 34 and filled at the same time in the concrete cells 42 of the roof 24. If wooden beams are alternately used instead of the concrete beams, the latter are bolted with threaded stems cast on the concrete walls and extending through the beams. The PVC extrusion constituting the roof will be anchored to the wooden beams by screws or by galvanized nails.

Figure 6:
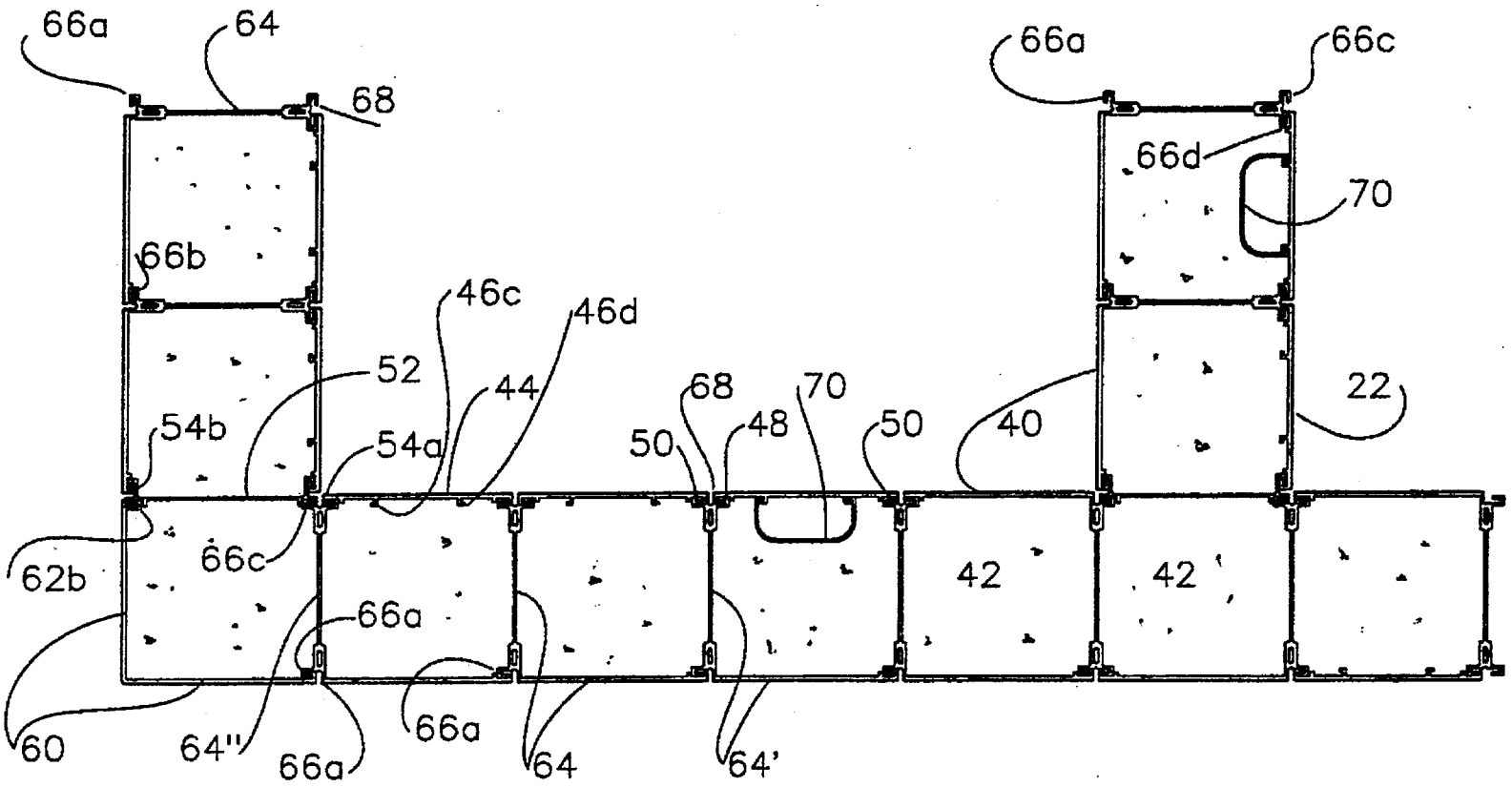
FIG. 6 is a horizontal sectional view of the interlocked wall panels from a corner and T-intersection of the building of FIGS. 1–2.
Figure 7:
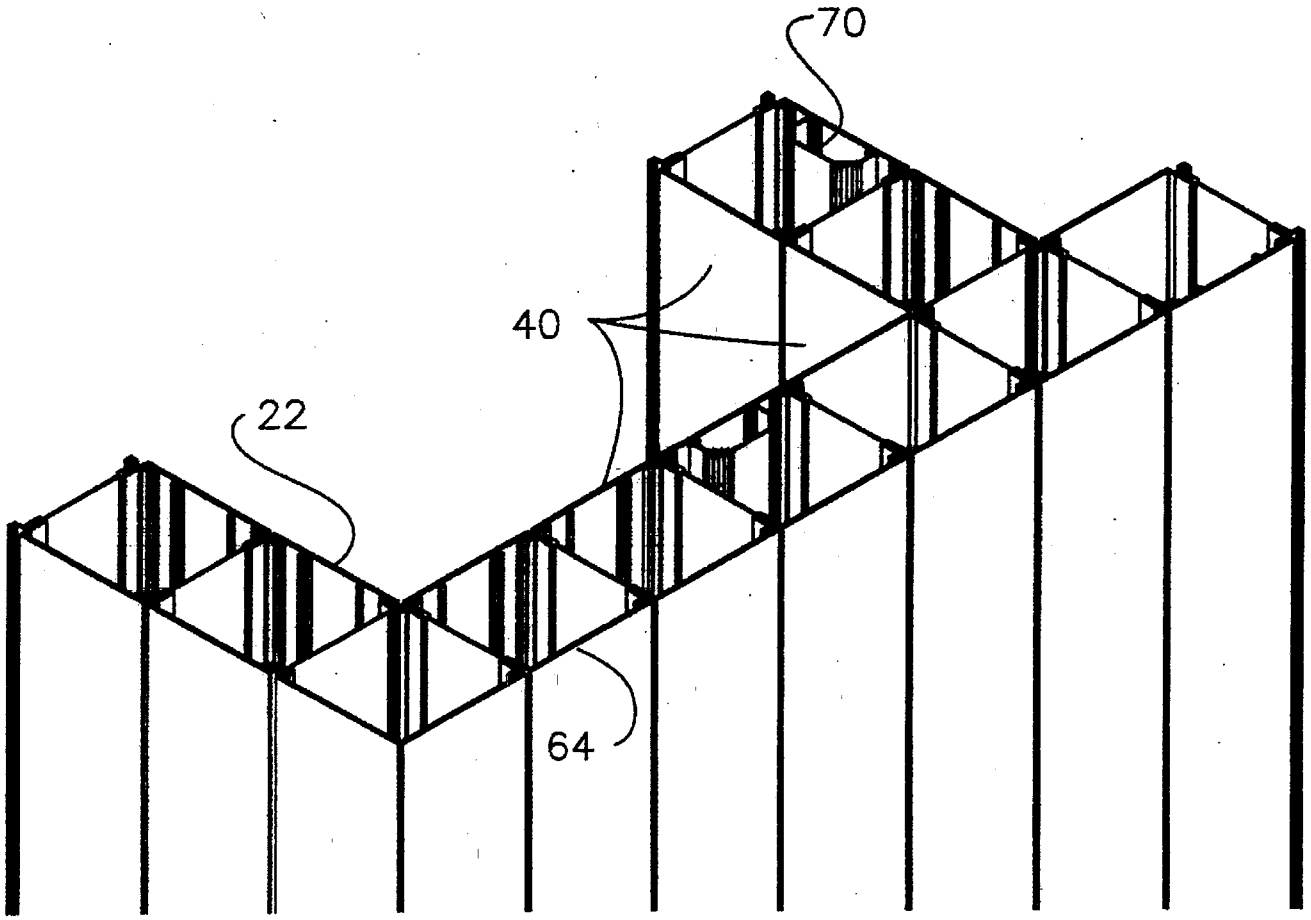
FIG. 7 is an isometric view of the elements from FIG. 6.

FIGS. 6 and 7 show in horizontal cross-section and in isometric view some of the side walls 22 of the house 20. As shown in these figures, the side wall 22 is hollow, consisting of a plurality of hollow panel assemblies 40, 40, . . . being interlocked to one another in successive pairs in a fashion detailed below. Each panel assembly 40 is rectangular, and preferably square, in cross-section, defining four side walls circumscribing a closed inner cell 42. The top end of the panel assemblies 40 forms an open mouth, adapted to receive flow-through concrete to be poured inside the panel assembly inner cell 42. The side walls of the panel assemblies 40 should be made from a waterproof, rigid material, being relatively thin while being capable of withstanding the loading of concrete inside the inner cell 42. Preferably this panel assembly side wall material will be an extruded thermoplastic sheet material.

Figure 8:
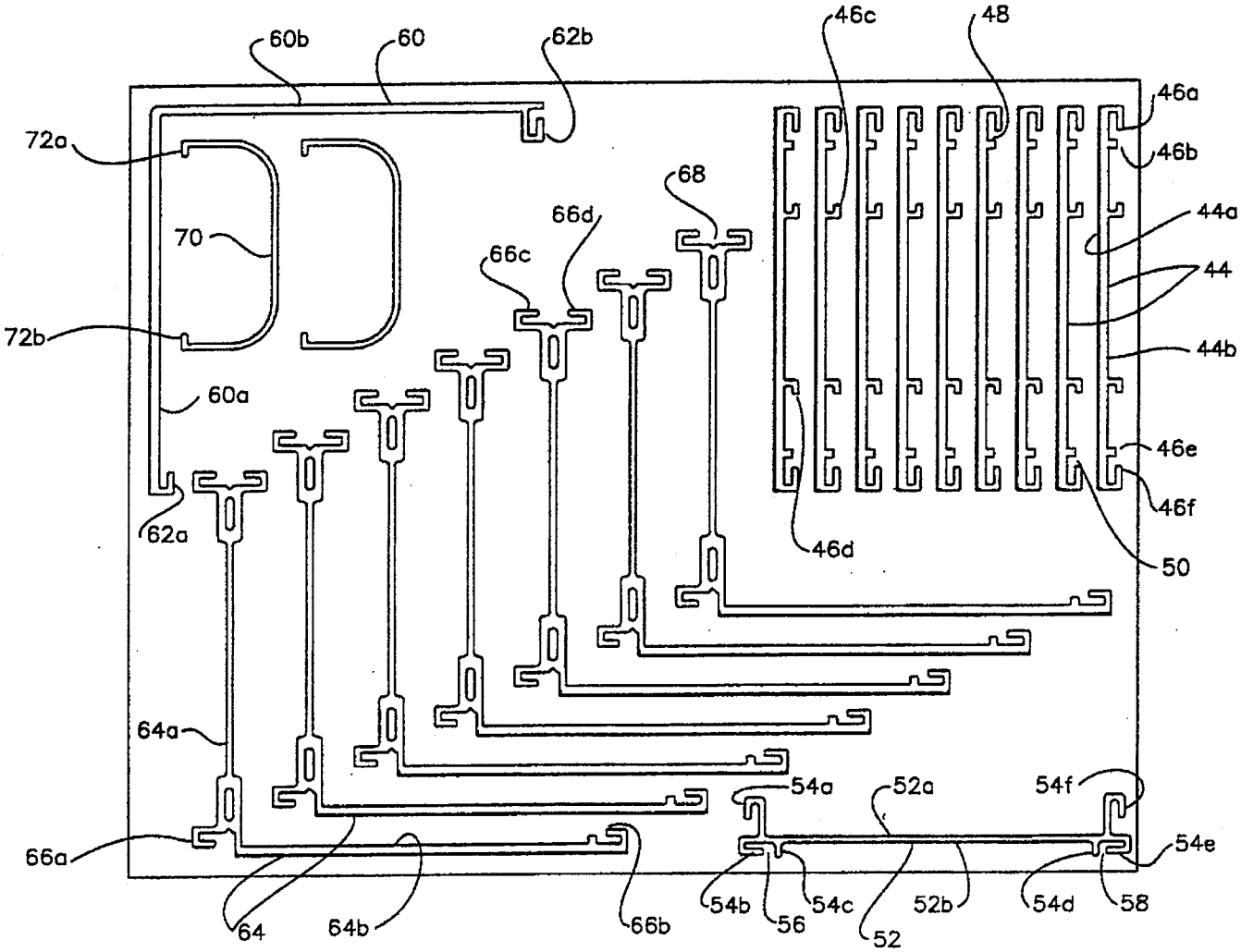
FIG. 8 is a top plan view of a plurality of the modular panel components in disassembled state, suggesting how they can be stored for shipping on a flat surface within minimal storage area.

FIGS. 8–13 show the various extruded thermoplastic sheet components making the various panel members forming the cross-sectionally quadrangular panel assemblies 40 of the house. FIG. 8 is particular suggests how the extrusion in their disassembled condition can be stacked to take the minimum volume, so as to reduce shipping costs. All the components have been thought off to enable the most efficient stacking features. The extrusions will be shipped in boxes into which may be loaded the various required structural components to make a given wall or roof area.

In the present invention, there are basically four main types of panel members, which are used for both the upright side walls 22 of the building as well as for the roof paneling 24:

1. a first panel member 44, FIG. 11, having a main flat face 44*a* and an opposite face 44*b* carrying six transverse fingers 46*a*, 46*b*, 46*c*, 46*d*, 46*e*, and 46*f*. Opposite ends fingers 46*a*, 46*f*, are each L-shape and inturned. Straight fingers 46*b*, 46*e*, project spacedly proximate the respective L-fingers 46*a* and 46*f*, to form a pair of opposite open end pockets 48, 50, respectively. Intermediate fingers 46*c*, 46*d*, are L-shape and outturned, i.e. with their outer legs directed away from one another.

2. A second panel member 52, FIG. 10, defining a main body being flat on both faces thereof 52*a* and 52*b*, and carrying a triplet of fingers 54*a*, 54*b*, 54*c*, and 54*d*, 54*e*, and 54*f*, at each of the two opposite edges thereof. J-shape fingers 54*a*, 54*f*, project from face 52*a* and are outturned. L-shape fingers 54*b*, 54*e*, project from face 52*b* and are inturned. Straight fingers 54*c*, 54*d*, project from face 52*b* spacedly proximate L-fingers 54*b*, 54*e*, to form a pair of opposite open end pockets 56, 58, respectively. This extruded component of FIG. 10 is also perforated, to allow therethrough uncured concrete flow as well as free passage of the reinforcing steel rods.

3. A third, cross-sectionally L-shape panel member 60, FIG. 13, defining a main body having a pair of opposite flat surfaces 60*a*, 60*b*, and carrying two ears 62*a*, 62*b*, at the opposite edges thereof. Ear 62*a* projects from face 60*a*, is L-shape and inturned; while ear 62*b* is J-shape, is outturned and also projects from face 60*a*.

4. A fourth, cross-sectionally L-shape panel member 64, FIG. 9, is provided, defining a main body having a pair of opposite, generally flat surfaces 64*a*, 64*b*, and carrying four ears 66*a*, 66*b*, 66*c*, and 66*d*. J-shape ear 66*a* projects outwardly from face 64*a* at the elbowed portion thereof. J-shape ear 66*b* projects transversely from face 64*b* at an end edge thereof; while J-shape ears 66*c* and 66*d* face one another and project transversely from faces 64*a* and 64*b* respectively at the end edge opposite J-shape ear 66*b*, so as to define a large open end pocket 68 therebetween. This component 64 is cross-sectionally V-shape, and has two sides of similar length. One of the sides may be made from a layer of recycled plastic material together with a coextruded finishing layer, forming the exposed part of the wall, while the opposite side is in fact the wall central core. The central core is perforated so as to allow free passage of uncured concrete from one cell to another, and also to enable free passage of reinforcing steel rods (not shown) to reinforce the wall. This extrusion consists of sliding anchors which permit to interconnect several of the components 64, with one another or with the extrusion of FIG. 11. Moreover, at the slider joint 68, the central sheet body core has been thickened, so as to enable the mounting of frame anchoring screws for cupboards 65 (FIG. 3), or other components requiring to be attached to the wall. The gap between the various extrusions enable to screw through this central core thickening 68 without compromising the finishing of the exposed surface.

The extrusion components 64 shown in FIG. 9 will be applied flatly against the rafters forming the roof frame 24. Once these extrusions 64 are anchored to the roof frame, additional extrusions will be mounted by sliding same from the top down of the building. The periphery of the roof will be closed by the flashing strips 33. These extrusions will keep the concrete in place during pouring thereof, and will ensure the presence of a peripheral flashing 33, around the roofing 24, and of a water outlet. Once all the roofing extrusions have been mounted and anchored, they are filled, one side at a time, at the front or at the rear, with regular concrete or with concrete containing polystyrene pellets. These polystyrene pellets will decrease the overall weight of the concrete, and thus the load supported by the extrusions, and will increase the thermal insulation ratio of the roof 24. Once the front part is filled with concrete, and after setting thereof, the rear part may be filled with concrete to thus complete the building.

Once the concrete has been completely poured, the building 20 will then become completely monolithic, and all the components will become anchored to one another as if they would have been cast all at the same time. The reinforcing steel anchoring will also be provided between the concrete flooring 26 and the walls 22.

Preferably, a cross-sectionally C-shape panel member 70, FIG. 12, may also be provided, having a pair of inturned flanges 72*a*, 72*b*, at opposite end edges thereof, for through passage by electrical lines (not shown). For accessing the electrical lines inside channel 70, there is only required to bore a hollow channel in the wall 44, to allow the electrical lines to extend to the top of the wall 22, and to jump from one room to another through the gap provided in the upper sill 37.

The V-shape component 64 in FIG. 9 constitutes the main portion of the present construction system. The component 52 in FIG. 10 is a connector element which enables to obtain the T intersections with the walls 22. In FIG. 11, the component 44 is used with component 64 of FIG. 9 to constitute one of the exterior faces of the walls 22. In FIG. 12, the component 70 is an extrusion with interlocks with the ears 46*c*, 46*d*, of component 44 of FIG. 10 inside the wall 22, so as to provide vertical channels for the eventual passage of electrical conduits. In FIG. 13, the component 60 is an extrusion which is used to make the corners of the building 20.

From FIG. 6, it will now be understood how the four main components of the invention can be interlocked to one another to form a building structure. Along a straight wall, each cross-sectionally quadrangular panel assembly 40 includes two L-shape panel components 64, 64', which make three of the four walls of the panel assembly 40 (one of the four legs thereof extending to a second adjacent panel assembly), and a flat panel component 44 interconnecting the two L-panel components 64, 64'. More particularly, the end ears 46*a*, 46*f*, of flat panel component 44 hookingly engage transversely into the free end channel pockets 68, 68, of the two L-panel components 64, 64' thus spacedly interlocking in parallel relationship the two corresponding legs of these panel components 64, 64'; while the ear 66*a* of one L-panel component 64 hookingly engages with the ear 66*b* of the adjacent L-panel component 64'; hence forming a stable cross-sectionally quadrangular hollow panel assembly 40.

An important advantage of such interconnection system for the panel components of a given pair of panel assemblies 40, 40, is the sliding adjustability of the ears 46*a*, 46*f*, lengthwisely of the channels formed by the L-panel pockets 68, 68. This relative sliding ability of the two L-panels 64, 64, enable unskilled workers to successively install these L-panels side by side, progressively, with minimal danger of accidental structural damage while providing continuous axial sliding adjustment capability therebetween. Such a construction system will therefore provide real cost savings with respect to the in situ labour force, thanks to foolproof panel assembly design. In fact, it is this foolproof assembly design, together with the compactness when disassembled for shipping purposes, that afford the unexpectedly high performance achieved with this panel assembly, compared with prior art systems, such as with the snap-on technique disclosed in U.S. Pat. No. 3,992,839, supra.

At corner portions of the side wall 22, the L-shape corner panel component 60 is used, for two of the four sides of the panel assembly 40. A flat panel component 52 is attached by its axial ear 54*b* to the ear 62*b* of L-panel 60. The last side of the quadrangular panel assembly 40 is formed by one leg of the L-shape component 64", with ear 66*c* thereof hooking with axial ear 54*e* of flat panel 52, and with ear 62*a* of L-panel 60 hooking with elbowed part ear 66*a* of L-panel component 64".

Whenever wiring or plumbing lines need to be carried by the wall panel 22 of the building 20, it is preferable that they be made to extend through the hollow 42 of the panel assemblies 40. To prevent the concrete to be poured into the hollow 42 of panel assemblies 40 from engaging these electrical lines, there is slidingly mounted to the flanges 46*c*, 46*d*, of flat structural panel 44, the cross-sectionally C-shape thermoplastic structural component 70. Hence, an inner chamber of channel is formed inside C-component 70, being separated in fluid-tight fashion relative to the main inner cell 42 of a hollow wall panel 40, for free passage of the electrical lines safe from the concrete inside cell 42.

Figure 15:
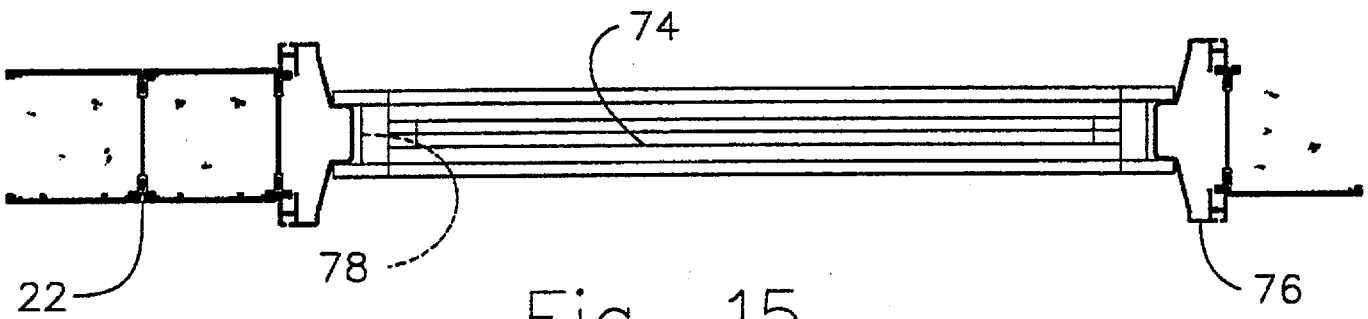

FIGS. 14 and 15 show door and window assemblies made with plastic extrusions. The windows 74 are mounted into the side wall 22 about a false frame 76 consisting of an extrusion. This extrusion 76 is used to support the windows 74 but also discloses a peripheral groove which may be used to hook shielding weather-boards to the false frame 76. The window frame 76 is installed at the same time as the wall extrusions 22. However, the window sill is installed only after concrete has set. The door 84 is hingedly mounted to a door frame 80, which is made from PVC and is connected to the wall extrusions 22 by a specific connector component 82 made also from plastic. The door frame installation is done in a similar fashion as that of the window frame installation, except that in FIG. 14, the connector extrusion 82 is used for anchoring the door frame 80 to the PVC frame.

Once the concrete has set, the window sill must be installed, and the window 74 itself must thereafter be mounted into the false frame 76. The door frame 80 may be mounted at the same time as the extrusions and be in position during concrete pouring.

The completed building thus consists of concrete walls covered with plastic, which may be left white or dyed (either deep-dyed or painted with a special paint). The edges of the windows and the soffits can however be of a different colour. The inside of the building thus consists of a white plastic surface for the walls and for the roofs, with the exposed rafters of varnished wood or cast concrete rafters in position inside a coloured fibreglass casing.

The plastic used can be from PVC or other thermosetting plastic material. The plastics used are freely available on the market and are currently manufactured by known corporations. The coextrusion system which will be used is a well known system in the industry, and by adding mineral fibres or filling materials thereto, resistance of plastic should be improved.

All the building system has been developed so that, during the preparation of the plans of the building, all the components forming the building be defined by computed-assisted design, to be thereafter manufactured and precut in the home factory. No component sectioning is required on the building site, and the system assembly is performed by unskilled labour. This system thus enables the conception and production at a large scale of the building, while considerably decreasing the timeframe for manufacture and execution thereof.

I claim:

1. An assembly of extruded thermoplastic structural components for use in the construction of the upright side walls and roofing of a building, each structural component including an elongated rigid sheet member provided with at least two integral lengthwise edgewise rail members, said structural components including first and third flat wall structural components and second and fourth elbowed corner structural components, wherein the second elbowed corner structural components are provided with at least three integral lengthwise rail members, and wherein a few of said structural components are releasably slidingly interlocked with one another about their said rail members, without tools being required, to form hollow elongated panels wherein each said hollow panel defines a main body, including a flat exterior face and a flat interior face, and circumscribing a generally closed inner enclosure cell, said inner cell for receiving concrete to be poured and said hollow panel body adapted to withstand the load of a column of concrete poured therein; said sliding interlock engagement between said few structural components forming said hollow panels defining continuous lengthwise adjustment means for one said structural component relative to the other of said few structural components, said hollow panels releasably interlocking with adjoining hollow panels successively to form a continuous wall structure; and wherein said structural components in their disassembled state released from one another are compactly stackable in the smallest volume of storage whereby shipping costs from the home country manufacture to the local building site are very low.

2. An assembly of extruded thermoplastic structural components as defined in claim 1, wherein the thermoplastic material used in said structural components is polyvinyl chloride, admixed with at least one of the following reinforcing and stabilizing material: mineral fibres and filling materials.

3. An assembly of extruded thermoplastic structural components as defined in claim 1, wherein each said first structural component further includes additional lengthwise rail members, located intermediately of the first mentioned rail members; and further including at least one additional structural component, being of cross-sectionally U-shape and having a pair of lengthwise edgewise flanges, said flanges slidingly adjustably releasably engaging said additional intermediate rail members of a given said first structural component wherein said first and additional structural components become interlocked; and wherein a generally closed channel is defined by said third structural component within said inner cell of a said hollow panel member, for free lengthwise passage of electrical lines.

4. An assembly of extruded thermoplastic structural components as defined in claim 1, wherein said second elbowed corner structural component defines a central body core, proximate a corresponding said rail member, said central body core being thickened so as to enable the mounting of frame anchoring screws for cupboards and the like articles requiring to be suspended over ground and to be attached to the inside face of said upright side walls of the building.

* * * * *